United States Patent [19]

Jakusch et al.

[11] 4,420,330

[45] Dec. 13, 1983

[54] STABILIZATION OF PYROPHORIC FERROMAGNETIC ACICULAR METAL PARTICLES CONSISTING ESSENTIALLY OF IRON

[75] Inventors: Helmut Jakusch, Frankenthal; Werner Loeser, Ludwigshafen; Eberhard Koester, Frankenthal; Peter Rudolf, Neuhofen; Werner Senkpiel, Laudenbach; Werner Steck, Ludwigshafen, all of Fed. Rep. of Germany

[73] Assignee: BASF Aktiengesellschaft, Fed. Rep. of Germany

[21] Appl. No.: 368,984

[22] Filed: Apr. 16, 1982

[30] Foreign Application Priority Data

Apr. 25, 1981 [DE] Fed. Rep. of Germany ..... 3116489

[51] Int. Cl.[3] ..... C22C 1/04

[52] U.S. Cl. ..... 75/0.5 AA; 75/0.5 BA; 148/6.35; 148/126.1; 427/127; 427/216

[58] Field of Search ..... 75/0.5 AA, 0.5 BA; 148/6.35, 126; 427/127, 216

[56] References Cited

U.S. PATENT DOCUMENTS

| | | | |
|---|---|---|---|
| 3,520,676 | 7/1970 | Stahr | 75/0.5 AA |
| 3,623,859 | 11/1971 | Aldridge | 75/0.5 AA |
| 3,767,477 | 10/1973 | McCabe et al. | 148/6.35 |
| 3,926,617 | 12/1975 | Beggs et al. | 75/0.5 BA |
| 3,967,986 | 7/1976 | Rau et al. | 148/105 |
| 4,155,748 | 5/1979 | Steck et al. | 75/0.5 AA |
| 4,207,092 | 6/1980 | Berry | 75/0.5 AA |
| 4,251,592 | 2/1981 | Takedoi et al. | 427/127 |

FOREIGN PATENT DOCUMENTS

| | | | |
|---|---|---|---|
| 2212934 | 9/1973 | Fed. Rep. of Germany . | |
| 47-16052 | 5/1972 | Japan | 75/0.5 AA |
| 1265768 | 3/1972 | United Kingdom . | |

OTHER PUBLICATIONS

Hollemann-Wiberg, Lehrbuch der anorganischen Chemie, 1964, pp. 398-402.

*Primary Examiner*—John P. Sheehan
*Attorney, Agent, or Firm*—Keil & Witherspoon

[57] ABSTRACT

A process for stabilizing pyrophoric acicular metal particles consisting essentially of iron, by reaction with oxygen-containing gases in two stages, wherein, in the first stage, up to $\frac{1}{3}$ of the passivating layer present in the final state is formed at from 25° to 45° C. and, in a subsequent second stage, the remainder of the passivating layer is formed at from 50° to 70° C.

4 Claims, No Drawings

STABILIZATION OF PYROPHORIC FERROMAGNETIC ACICULAR METAL PARTICLES CONSISTING ESSENTIALLY OF IRON

The present invention relates to a process for stabilizing pyrophoric acicular metal particles consisting essentially of iron, by reaction with oxygen-containing gases at an elevated temperature.

The use of acicular ferromagnetic metal particles with single-domain characteristics as magnetizable material for the production of magnetic recording media is known. The high coercive force and high residual magnetization attainable with such materials soon prompted a search for simple methods of preparing them. While these materials have excellent magnetic properties, they also have the disadvantage of being pyrophoric. One of the supposed causes of the pyrophoric characteristics is the extremely fine particle size of the metal powders, namely from 50 to 2,000 Å, and the resulting large free surface area. On the other hand, lattice defects have also been discussed as a possible cause (cf. Hollemann-Wiberg, Lehrbuch der anorganischen Chemie, 1964, page 398). It is true that the pyrophoric character of the metal powders can be eliminated by heating. However, heating of such fine metal powders, especially where they consist of acicular particles, causes sintering which substantially increases the width of the particles, i.e. causes them to lose their acicular shape. Since, however, the coercive force of ferro-magnetic metal powders is dependent on the acicular shape and attains a maximum at particle widths of from 100 to 500 Å, it is necessary, for the attainment of good magnetic properties, to keep the particle size in this range, and accordingly heating alone is not a suitable method of eliminating the pyrophoric character of metal powders.

It is known that pyrophoric metal powders can be stabilized by coating the particles with an oxide layer by controlled oxidation. This can be effected, at from 20° to 50° C., by passing over the powder an inert gas which initially contains little oxygen and whose oxygen concentration is raised slowly in the course of the reaction (German Laid-Open Application DOS No. 2,028,536). The processes disclosed in German Laid-Open Applications DOS Nos. 2,212,934 and 2,361,539 are carried out similarly. However, these processes have the disadvantage that because of the high reaction enthalpy during the formation of the iron oxide layer it is necessary for both the reaction temperature and the oxygen content of the gas to be very low, so that the heat of reaction generated can be removed by appropriate means, for example by the stream of gas in the reaction zone. As a result, stabilization processes carried out accordingly are mostly very time-consuming. Moreover, the oxide protective layers are at times insufficiently uniform, so that on subsequent conversion of these metal powders to magnetic coatings for magnetic recording media, mechanical stressing of the particles during dispersion in an organic binder results in non-stabilized surface regions. It is true that shorter stabilization times can be achieved at higher temperatures, just below the autodeflagration temperature, but in that case control of the course of the reaction is extremely critical and the results are difficult to reproduce. The process disclosed in German Laid-Open Application DOS No. 2,524,520, in which, while the reaction temperature is maintained at about 40° C., controlled by the gas stream, the reaction time is shortened by effecting the reaction with an oxygen-containing gas under superatmospheric pressure, is not fully satisfactory either since it is too expensive in relation to the attainable results.

It is an object of the present invention to provide a process for stabilizing acicular ferromagnetic particles consisting essentially of iron, which avoids the above disadvantages and gives stabilized metal particles which, especially when used as magnetic materials for magnetic recording media, are more easily incorporated into the organic binder system and hence give a higher coercive force and higher remanence.

We have found that, surprisingly, this object is achieved with a process for stabilizing pyrophoric acicular ferromagnetic particles consisting essentially of iron by reaction with oxygen-containing gas, wherein, in a first stage at from 25° to 45° C., up to $\frac{1}{3}$ of the passivating layer present in the final state is formed and thereafter, in a second stage at from 50° to 70° C., the pyrophoric particles are treated with an oxygen-containing inert gas until the entire passivating layer has formed, the temperature range for each stage being controlled by means of the oxygen content of the inert gas stream.

In an advantageous embodiment of the novel process, the pyrophoric metal particles are treated with an oxygen-containing inert gas in the first stage for from 0.5 to 2 hours at from 25° to 45° C. and thereafter, in the second stage, for from 2 to 20, especially from 4 to 10, hours at from 50° to 70° C., the particular temperature range being controlled by means of the oxygen content of the inert gas stream.

To carry out the process according to the invention, the conventionally prepared finely divided pyrophoric ferromagnetic acicular metal particles consisting essentially of iron are exposed to an oxygen-containing inert gas stream, in general an air/nitrogen stream. This can be done by passing the gas stream over the material in a rotary kiln or by carrying out the process in conventional fluidized bed furnaces for the purpose, using an air/inert gas mixture as the fluidizing gas. During the process of stabilization of the pyrophoric metal particles, the temperature is controlled by regulating the oxygen content of the gas stream.

It is essential, for the process according to the invention, that the two stages of the stabilizing process be carried out in immediate succession. The completion of stabilization of the metal particles can then be detected from the drop in the reaction temperature while the other process conditions remain constant.

In the process according to the invention, it has moreover proved particularly advantageous if the difference in reaction temperature between the first and second stages of the stabilization is from 15° to 20° C.

The starting materials employed are acicular ferromagnetic metal powders which consist essentially of iron but may also contain cobalt and/or nickel. The pyrophoric metal powders are advantageously prepared in a conventional manner by reduction of the corresponding metal oxide powders by means of a gaseous reducing agent, preferably hydrogen or a hydrogen-containing gas, at not more than 500° C., preferably from 250° to 400° C.

The process according to the invention permits effective stabilization of the finely divided ferromagnetic particles consisting essentially of iron. As a result of the two-stage process, these particles are enclosed in a particularly uniform oxide coating, a result which cannot be obtained by, for example, post-passivation of already passivated material at a higher temperature.

Accordingly, such stabilized metal particles are exceptionally suitable for the production of magnetic recording media, since they can be processed without special precautionary measures and in particular are extremely suitable for incorporation into the organic binder system. This particularly good stability during dispersion of the stabilized metal particles obtained in the process according to the invention gives magnetic recording layers with apprecially higher remanence. Further, the material prepared by the process according to the invention, apart from having a higher coercive force, in general exhibits a narrower field strength distribution, ie. a narrower particle size distribution.

The Examples and Comparative Experiments which follow illustrate the advantages of the metal particles prepared according to the invention over particles prepared according to the prior art.

EXAMPLE 1

4,000 parts of a pyrophoric acicular ferromagnetic iron powder, prepared as described in Example 1 of U.S. Pat. No. 4,155,748, were fluidized in a fluidized bed oven by means of a stream of nitrogen of 10 $m^3$ (S.T.P.)/h. Air was then introduced into the stream of nitrogen, in such an amount that the product temperature resulting from the exothermic oxidation process assumed a value of 40° C. After 30 minutes, the proportion of air in the fluidizing gas was increased so as to bring the product temperature to 60° C. After a further 1.5 hours, the temperature began to drop. The nitrogen in the fluidizing gas was then replaced by air and, when the stabilized material had cooled, it was discharged from the fluidized bed oven.

392 parts of an iron powder, stabilized as above, were mixed with 105 parts of a 20% strength solution of a polyphenoxy resin, having a molecular weight of 30,000, in a mixture of equal parts of tetrahydrofuran and dioxane, 392 parts of a 12.5% strength solution of a thermoplastic polyester-urethane, prepared from adipic acid, 1,4-butanediol and 4,4'-diisocyanatodiphenylmethane, in a mixture of equal parts of tetrahydrofuran and dioxane, 47.7 parts of a commercial anionic wetting agent based on phosphoric acid esters and 973 parts of the above solvent mixture, and the batch was dispersed for 8 hours in a vibratory ball mill, using steel balls of 2 mm diameter. Thereafter, 212 parts of the above 12.5% strength solution of a thermoplastic polyester-urethane, obtained from adipic acid, 1,4-butanediol and 4,4'-diisocyanatodiphenylmethane, in a mixture of equal parts of tetrahydrofuran and dioxane, 56.7 parts of the above phenoxy resin solution and 1.12 parts of a commercial silicone oil were added, and dispersion was continued for an hour. The dispersion was then filtered and applied in a conventional manner to a 6 μm thick polyethylene terephthalate film, in such an amount that after orienting the acicular particles by passing the conted film through a magnetic field, and subsequent drying and calendering, a 7.1 μm thick magnetic layer remained.

The magnetic properties of this layer were measured by means of a vibrating sample magnetometer at a field strength of 160 kA/m. The coercive force $H_c$[kA/m], the remanence $M_r$[mt], the ratio of remanence to saturation magnetization $M_r/M_m$ and the orientation ratio OR, ie. the ratio of residual induction, in the layer, in the direction of particle orientation to that in the cross-wise direction, were determined. The values measured are shown in Table 1.

COMPARATIVE EXAMPLE 1

The procedure followed was as described in Example 1, except that the stabilization process was carried out at a product temperature of 40° C. only. The drop in reaction temperature occurred after 3.5 hours. The stabilized iron powder was used to prepare a magnetic layer as described in Example 1. The magnetic properties are shown in Table 1.

COMPARATIVE EXPERIMENT 2

The procedure followed was as in Comparative Experiment 1, except that the stabilization was carried out at a product temperature of 60° C., for 2 hours. The magnetic properties are shown in Table 1.

COMPARATIVE EXAMPLE 3

Taking suitable precautionary measures, an unstabilized iron powder, as employed in Example 1, was used to prepare a magnetic layer by the method described in Example 1. The magnetic properties are shown in Table 1.

COMPARATIVE EXPERIMENT 4

An iron powder stabilized at a product temperature of 40° C. as in Comparative Experiment 1 was subsequently passivated at 60° C. However, to obtain this temperature during the passivation treatment, the requisite heat had to be provided externally since the heat of reaction no longer sufficed. During the passivation, the proportion of air in the nitrogen fluidizing gas was 34 percent by volume. After 8 hours, the iron powder was cooled, discharged from the fluidized bed oven and used to prepare a magnetic layer as described in Example 1. The magnetic properties are shown in Table 1.

TABLE 1

| | $H_c$ | $M_r$ | $M_r/M_m$ | OR |
|---|---|---|---|---|
| Example 1 | 89.9 | 228 | 0.77 | 1.90 |
| Comparative Experiment 1 | 81.8 | 187 | 0.71 | 1.43 |
| Comparative Experiment 2 | 82.4 | 182 | 0.71 | 1.47 |
| Comparative Experiment 3 | 87.1 | 220 | 0.73 | 1.64 |
| Comparative Experiment 4 | 81.5 | 161 | 0.71 | 1.44 |

EXAMPLE 2

A pyrophoric acicular ferromagnetic iron powder prepared as described in Example 4 of U.S. Pat. No. 4,155,748 was stabilized by the method described in Example 1 above, except that in the first stage the temperature of 40° C. was maintained for one hour. Preparation of a magnetic layer with the stabilized iron powder was carried out as described in Example 1. The magnetic properties are shown in Table 2.

COMPARATIVE EXPERIMENT 5

The procedure followed was as described in Example 2, except that the stabilization process was carried out at one temperature only, namely 40° C. The drop in reaction temperature occurred after 5.5 hours. Preparation of a magnetic layer with the resulting iron powder was carried out as described in Example 1. The magnetic properties are shown in Table 2.

TABLE 2

| | $H_c$ | $M_r$ | $M_r/M_m$ | OR |
|---|---|---|---|---|
| Example 2 | 81.6 | 282 | 0.79 | 2.1 |
| Comparative Experiment 5 | 79.8 | 240 | 0.78 | 2.0 |

We claim:

1. A process for stabilizing pyrophoric acicular ferromagnetic metal particles consisting essentially of iron, by reaction with oxygen-containing gases, wherein, in a first stage at from 25° to 45° C., up to ⅓ of the passivating layer present in the final state is formed and thereafter, in a second stage at from 50° to 70° C., the pyrophoric particles are treated with an oxygen-containing inert gas until the entire passivating layer has formed, the temperature range for each stage being controlled by means of the oxygen content of the inert gas stream.

2. A process as claimed in claim 1, wherein the pyrophoric metal particles are treated with an oxygen-containing inert gas in a first stage for from 0.5 to 2 hours at from 25° to 45° C. and thereafter, in a second stage, for from 2 to 20 hours at from 50° to 70° C., the particular temperature range being controlled by means of the oxygen content of the inert gas stream.

3. A process as claimed in claim 1, wherein the difference in reaction temperature between the first and second stage is from 15° to 20° C.

4. A process as claimed in claim 2, wherein the difference in reaction temperature between the first and second stage is from 15° to 20° C.

* * * * *